US006782720B2

(12) United States Patent
Vero et al.

(10) Patent No.: US 6,782,720 B2
(45) Date of Patent: Aug. 31, 2004

(54) UNILAYER FABRIC WITH REINFORCING PARTS

(75) Inventors: Frederick A. Vero, East Hampton, NY (US); Fred Adams, Decatur, AL (US)

(73) Assignee: Lakeland Industries, Ronkonkoma, NY (US)

( * ) Notice: Subject to any disclaimer, the term of this patent is extended or adjusted under 35 U.S.C. 154(b) by 102 days.

(21) Appl. No.: 10/060,718

(22) Filed: Jan. 30, 2002

(65) Prior Publication Data

US 2003/0140396 A1 Jul. 31, 2003

(51) Int. Cl.[7] ..... D04B 7/34

(52) U.S. Cl. ..... 66/171; 66/174; 66/232; 2/161.6; 2/167; 2/169

(58) Field of Search ..... 2/167, 169, 16, 2/161.6, 161.7, 2.5; 66/232, 174, 45, 196, 169 R, 171, 202; 700/141; 442/304, 312, 313, 318, 239, 243; 428/365

(56) References Cited

U.S. PATENT DOCUMENTS

| | | | | | |
|---|---|---|---|---|---|
| 2,342,547 | A | * | 2/1944 | Kuehnel | 2/158 |
| 2,357,506 | A | * | 9/1944 | Davis | 66/41 |
| 2,899,812 | A | * | 8/1959 | Attenborough | 66/169 R |
| 3,434,305 | A | * | 3/1969 | Bentley et al. | 66/5 |
| 4,377,195 | A | * | 3/1983 | Weil | 66/195 |
| 4,858,245 | A | * | 8/1989 | Sullivan et al. | 2/21 |
| 4,912,781 | A | * | 4/1990 | Robins et al. | 2/2.5 |
| 5,210,877 | A | * | 5/1993 | Newman | 2/456 |
| 5,388,050 | A | * | 2/1995 | Inoue et al. | 700/131 |
| 5,399,418 | A | * | 3/1995 | Hartmanns et al. | 428/218 |
| 5,511,394 | A | * | 4/1996 | Shima | 66/232 |
| 5,745,919 | A | * | 5/1998 | Kraatz | 2/161.6 |
| 5,822,791 | A | * | 10/1998 | Baris | 2/2.5 |
| 5,823,012 | A | * | 10/1998 | Hacskaylo | 66/171 |
| 5,881,572 | A | * | 3/1999 | Plemmons et al. | 66/65 |
| 6,155,084 | A | * | 12/2000 | Andrews et al. | 66/174 |
| 6,233,979 | B1 | * | 5/2001 | Plath | 66/232 |
| 6,305,196 | B1 | * | 10/2001 | Takeshita et al. | 66/195 |
| 6,534,175 | B1 | * | 3/2003 | Zhu et al. | 428/365 |

FOREIGN PATENT DOCUMENTS

| | | | | |
|---|---|---|---|---|
| JP | 2000064161 A | * | 2/2000 | D04B/23/16 |
| WO | WO 01/36729 A1 | * | 5/2001 | |

* cited by examiner

*Primary Examiner*—Rodney M. Lindsey
(74) *Attorney, Agent, or Firm*—John Lezdey

(57) ABSTRACT

The present invention relates to a unilayer flexible performance fabric which may be fabricated into apparel and articles having high performance fibers, such as high tensile modulus fibers positioned within a base fabric in at least one preselected location only where required to import performance characteristics which are equal to or exceed the specifications for the garment. For example, if cut resistance is a requirement, performance fibers which provide such protection from this hazard would be used. Likewise, if abrasion resistance is intended for an apparel such as coveralls, only the knees and elbows would require the performance fiber. Thus, reducing the amount of expensive fibers normally used. The invented fabric is manufacturede in a method in which the placement of the fabric in preselected locations is computer controlled.

14 Claims, 3 Drawing Sheets

PRIOR ART

UNILAYER FABRIC WITH REINFORCING PARTS

BACKGROUND OF THE INVENTION

1. Field of the Invention

The present invention relates generally to forming textile fabrics with selectively placed interlocking high tensile modular filaments to produce garments and articles having enhanced performance characteristics. More particularly, the invention relates to protective work garments. The invention also relates to a method of producing a unilayer textile fabric where high tensile modular filaments are knitted into preselected locations on the textile fabric and the process is controlled by a computer.

2. Brief Description of the Prior Art

The prior art has provided fabric of specific constructive design to overcome particular hazards encountered on the work environment. Generally in such construction, the patents disclose composite requiring layers of high tensile modular filaments which may be further treated by dipping to form a protective fiber or by heat treatment. Such is the case in providing cut resistant fabric for gloves for use by metal working glass handlers, meat cutters, and medical personnel. Each requires protection from a different hazard. The metal workers and glass handlers typically do not need protection from fluids. On the other hand, meat cutters and medical personnel do need this fluid protection to prevent bacterial or viral infection.

U.S. Pat. No. 4,004,295 discloses a glove constructed of yarn of metal wire and a non-metalic fiber such as an aramide fiber as protection from knife cuts.

U.S. Pat. No. 4,651,514 relates to a yarn composed of a monofilament nylon core that is wrapped with at least one strand of aramide fiber and a strand of nylon fiber. This yarn is electrically nonconductive.

Other special fabrics are designed for firefighters, foundry workers, and personnel in the chemical and related industries. Again, additional protection beyond the cut and puncture resistance is required. Generally, this again involves protecting the skin from hazardous liquid chemicals. These include solvents, paints, varnishes, glues, cleaning agents, degreasing agents, drilling fluids, inter alia.

U.S. Pat. Nos. 4,479,368 and 4,608,642 which are herein incorporated by reference disclose programmable knitting machines which may be used in preparing the fabrics of the invention.

U.S. Pat. No. 4,302,851 to Adair discloses a heat resistant protective hand covering in which a wool knit liner is enclosed within an outer layer of woven KEVLAR® aromatic polyamide fiber material with layers of aluminum foil and flexible fiberglass sandwiched there between. A pleated pad of flexible material woven from fiberglass yarns.

U.S. Pat. No. 4,433,479 to Sidman et al., relates to a heat resistant glove having first and second shells formed of temperature-resistant aromatic polyamide fibers such as KEVLAR® with the first shell section being made of a twill weave fabric and the second shell being made of a knitted fabric. A liner is formed of two sections, both are made of a felt fabric of temperature resistant aromatic polyamide fiber with the section forming the palm being provided with a flame resistant elastomeric coating.

U.S. Pat. No. 5,965,223 to Andrews et al, which is herein incorporated by reference discloses a composite layered protective fabric having an outer primary layer of an abrasive material and an inner layer of a cut resistant material positioned below the outer layer.

In each case the prior art patents discussed above requires a plurality of layers to achieve the protection desired. Usually each layer being fabricated of a uniform composite structure. Thus the weight of the fabric is in increased and flexibility and comfort level of the wearer of the garment produced decreased. Furthermore, the extensive use of high performance filaments makes the articles of manufacture more expensive.

Therefore, there exists a need for a flexible and comfortable textile performance protect fabric that is less expensive, more efficient to fabricate, reduces the amount of high performance filaments yet provides the necessary protective characteristics.

SUMMARY OF THE INVENTION

In accordance with the present invention a flexible unilayer fabric is produced in which the interlocking or intertwining of at least one dissimilar filament into preselected pattern at definite locations or regions of a base fabric by essentially conventional textile manipulating techniques controlled by a computer. The base fabric is formed from natural material or synthetic organic polymers that have a tensile modulus of about 3,000 kg/mm$^2$ or less. The performance filaments usable in the present invention have a high tensile modulus of elasticity of about 5,000 kg/mm$^2$ or more. The high tensile modulus filaments used may vary widely and include inorganic and organic filaments depending on the functional use. However, these high performance materials are very expensive and reducing the amounts without sacrificing performance is accomplished by the present invention.

For comfort and economic reasons the base fabric is manufactured preferably from a less expensive natural fiber such as cotton. As mentioned above type of high tensile modulus filament to be used is predicated on improving the effectiveness of the fabric for an intended function. For example, if garments are expected to provide protection to the wearer from hazards such as abrasions, cuts and punctures, a cut resistant filament is knittingly secured into the base fabric by a computer controlled pattern device. The encoded pattern information (design and location data) will direct the manipulation of the needles to interlock the filaments, for example, only in the finger and thumb stalls and in the palm region of the glove. Preferably the interlocking step is done by knitting. The high tensile modulus filaments are selected from the group consisting of aramides extended chain polyethylene, extended chain polypropylene, liquid crystal polyester, polyolefins, polyesters, polyamides, carbon fibers, metal fibers, fiberglass, and mixtures thereof.

The invention provides a method of manufacturing a unilayer flexible performance textile fabric having at least one high performance filament interlocked or intertwined within the base fabric to enhance an intended function. The first step involves manipulating the performance filament using substantially conventional textile fabric forming technology such as stitching to form a base fabric. The next step also follows conventional techniques such as by knitting the high modulus filament into the base fabric wherein the placement and design of the pattern of the high modulus filament is controlled by the pattern data supplied to a microprocessor to which the manipulations of the knitting needles are responsive providing the pattern programmed in the same single layer as the base fabric It is the primary object of the invention to provide a unilayer fabric that enhances the performance of an intended function, yet reduces the weight of the apparel or article of manufacture with single layer construction.

Another object of the present invention is to provide a fabric containing high tensile modulus filaments in pre-selected locations within the fabric.

A further object of the invention is to provide a large variety of apparel and articles fabricated from the fabric of the invention.

A still further object of the present invention is to provide performance apparel used for protection against numerous potential hazards.

Yet another object of the present invention is to maximize the effectiveness of expensive high performance material.

Still another object of the present invention relates to articles of manufacture fabricated totally or in part a glove from fabric of this invention.

Another object of the present invention is to provide a glove construction of a unilayer fabric with high tensile modular filaments knitted into the base fabric conforming to the pattern and location programmed and controlled by a computer to form "islands of reinforcement" in the finger, thumb and palm regions against sharp objects.

DETAILED DESCRIPTION OF THE PREFERRED EMBODIMENTS

Figure 1:
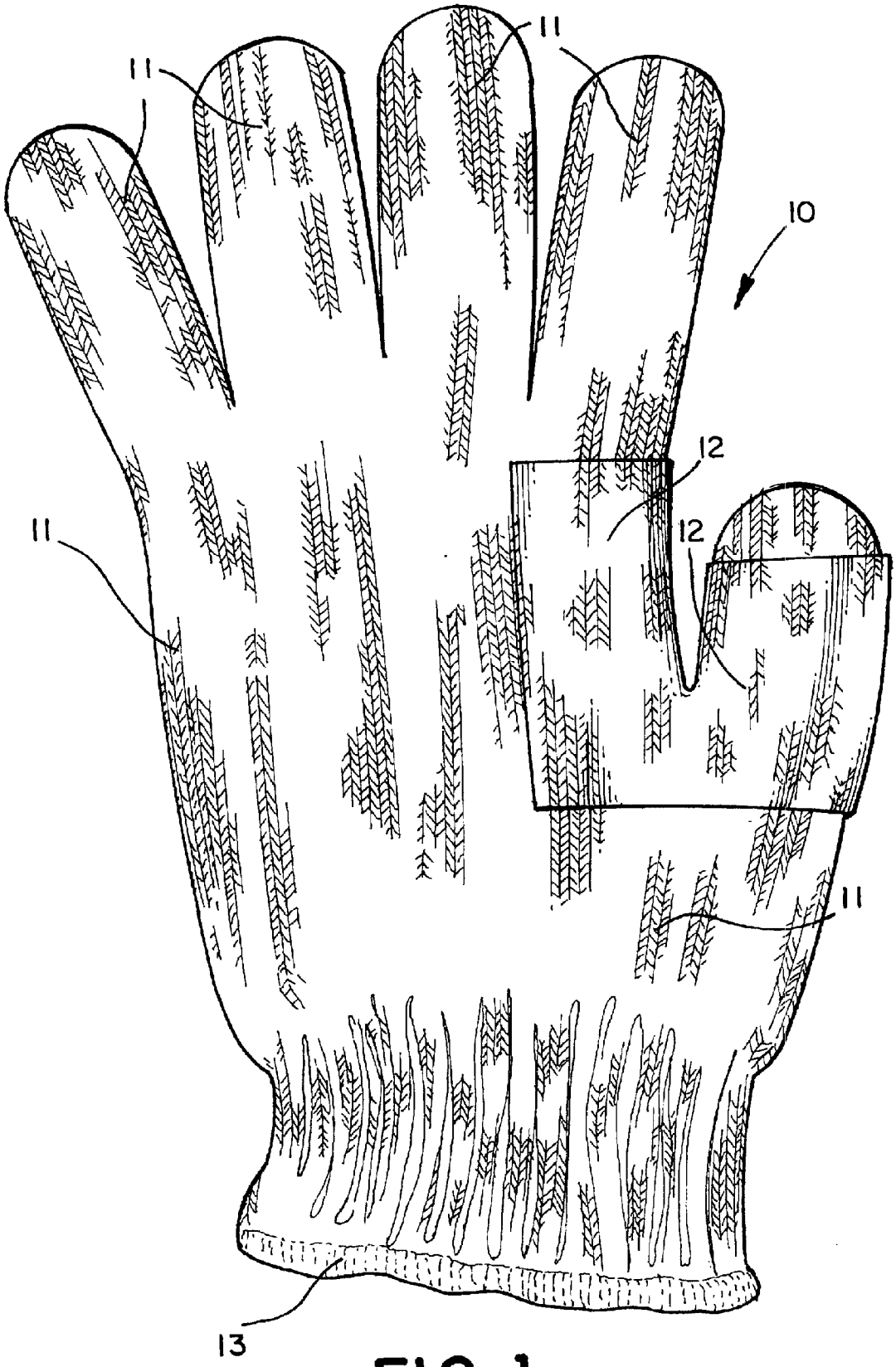
FIG. 1 is a knit glove formed by the method of the invention.

As shown in FIG. 1 there is provided a fabric in the form of a knit glove with an elastic band 13 and having a substantial area of cotton and two areas of a high modulus synthetic fiber 12 such as KEVLAR®. Both the cotton fibers 11 and the synthetic fibers are single layered. The prior art method to provide a reinforcement has generally been to over knit an area so as to form a double layer.

Figure 2A:
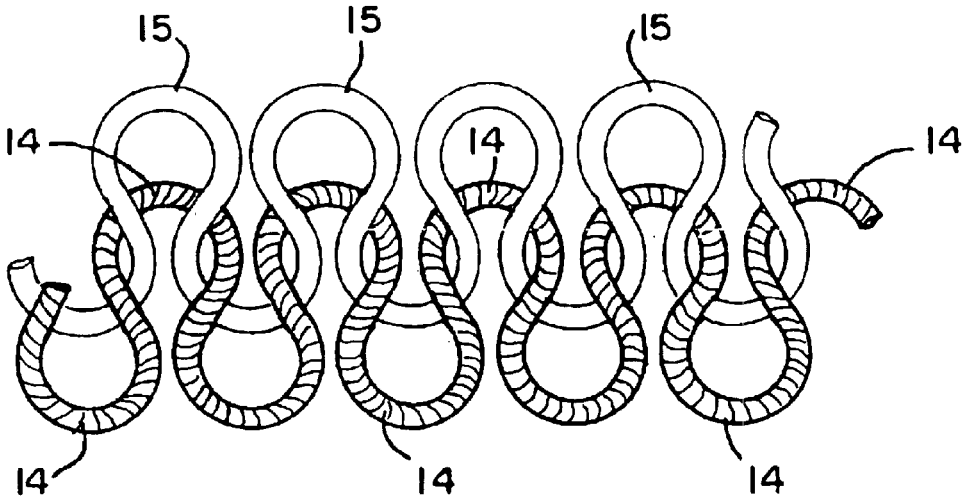
FIG. 2A PRIOR ART
FIG. 2A shows a prior art method of chain looping two different fibers together in a single layer.

FIG. 2A illustrates a prior art method of incorporating a high modulus fiber 14 to form a single layer fabric by primarily alternating the looping of a synthetic fiber onto a natural fiber 15.

Figure 2B:
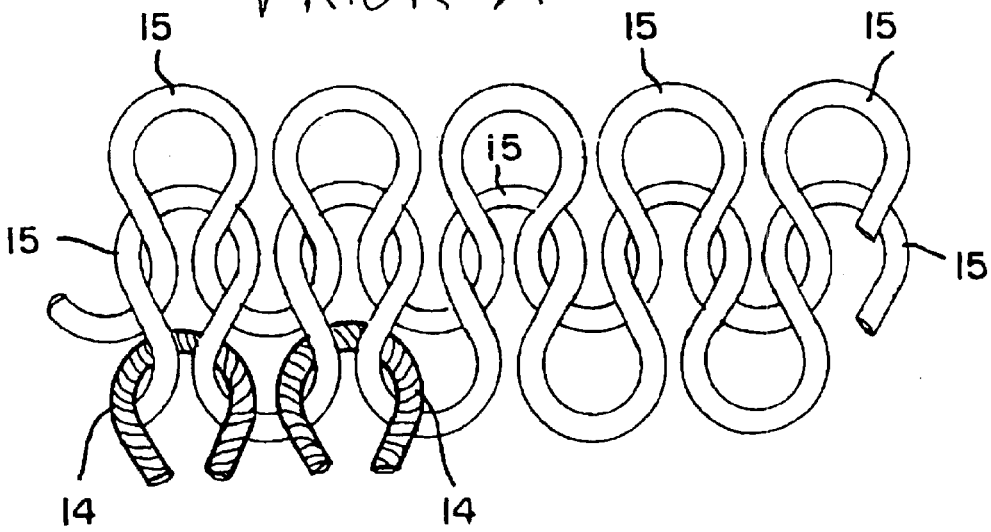
FIG. 2B illustrates the prior art double layer method of chain linking two different fibers.

FIG. 2B illustrates the prior art method of forming fabrics with a layer of a double layer natural fiber 15 that is looped with a high modulus fiber 14.

Figure 3:
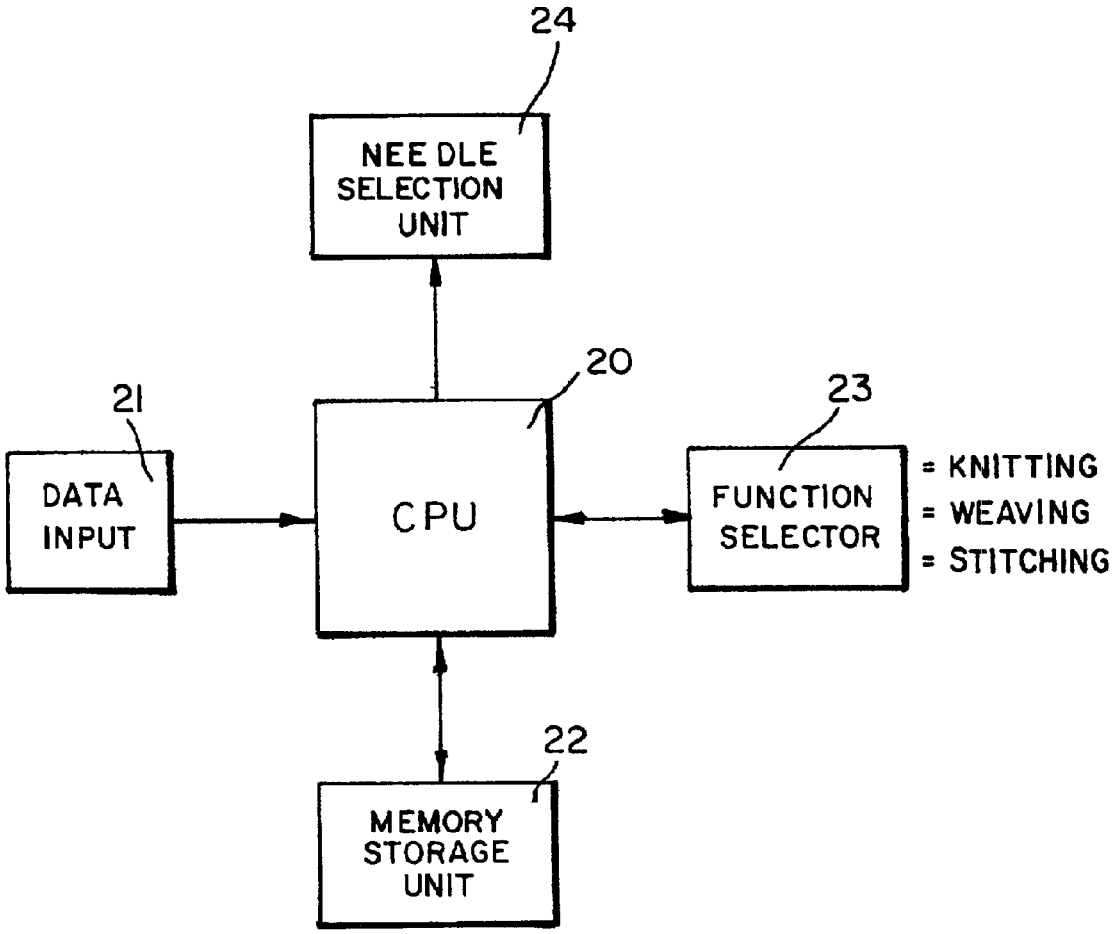
FIG. 3 shows a flow diagram of the process of the invention.

FIG. 3 shows a flow diagram of the composite controlled process used in the process wherein a microprocessor 20 receives a program in the data input unit 21. The microprocessor then signals the function selector 23 to decide on the type of weave, namely, knitting, weaving, or stitching depending upon the location. With the desired information there is a selection of needles by the needle selection unit 24. The operation is continuous by storing the process in the memory storage unit 22.

The product of the invention is made using chain stitches. The machine picks up the programmed material carrier and at the same time preselected needles raise up to knit the material. Then this material is dropped off and another material carrier is picked up which then knits this material in a preselected location. Using this process one is able to put material in any location on the product.

The present invention in its broadest aspect is a flexible unilayer textile performance fabric comprising a base fabric formed from a first fiber having the design of a desired pattern formed therein by intertwining or interlocking in the same layer at least one dissimilar performance fiber which can be manipulated in accordance with conventional textile fabric manufacturing process but wherein such manipulation is computer controlled. A programmed computer encodes the location(s) and the design of the desired pattern. After such data is entered, this enables the manipulation processes to place such designs in designated locations. This effectively maximizes the benefits of the expensive high performance material while reducing the amount of material needed. For example, if abrasion resistance is needed in an anti-wear garment only those areas requiring this added performance, i.e., elbows and knees would have the performance filaments to provide the desired characteristics.

Broadly, a method of manufacture of the unilayer flexible performance textile fiber comprises the steps of:

(a) manipulating a first fiber in a conventional manner to form a base textile fabric in a single layer; and (b) manipulating at least one dissimilar performance fiber into the base textile fabric wherein this step of manipulating is computer controlled to produce a predetermined design for a pattern at a pre-selected location within the base textile fabric to form a performance fabric having enhanced performance function.

The first manipulative step (step (a)) involves a stitching operation which is performed by a knitting, sewing, or weaving machine to form a base textile fabric having a mesh or web configuration. The base is then downloaded into a knitting machine.

The type of stitching in the first manipulative step may vary widely. Stitching and sewing methods such as chain stitching, lock stitching and the like are illustrative of the type of stitching for use in this invention. The nature of the stitching fiber or thread will also vary widely and any type of fiber can be used depending on the garment and its use.

More specifically in step (b) the manipulation of the dissimilar performance fiber into the base textile fabric is conducted on a programmed knitting machine. The programming means comprises a microprocessor connected electronically to a programming matrix that controls a fiber carrier while simultaneously activating a needle selection means responsive to an output signed from the microprocessor and then to a pre-selected needle which knits the performance fiber into the web of the base fabric. This fiber carrier is released and in response sends a corresponding impulse to the microprocessor consistent with the input of the pattern and location data; another fiber carrier carrying another performance fiber supplies the fiber to the pre-selected needle which knits the filament into the proper location in the web of the base fabric. This sequence is repeated for each course in the base fabric in a sequential order of knitting. Thus, the fibers can be knitted in any location within the base fabric.

The invented fabric can be produced on essentially conventional textile fiber manufacturing equipment to produce such textile mechanical manipulative functions of sewing, knitting or weaving that are capable of producing the interlocking or intertwining steps of at least one dissimilar performance fibers into the base fabric and where this equipment is modified to effect the computer controlled processes described.

Several advantages flow from this arrangement. The design of a pattern and the textile mechanical manipulation steps or steps may be places into coding matrix electrically connected to the microprocessor unit. This input data may be stored as electrical data on any desired medium, such as a disc or tape. Once this data has been entered, the manipulative steps, i.e. knitting, can take place normally without any necessity to stop the machine or in general terms where to locate the design on the base fabric and where the pattern should begin and end. Units of pattern information so stored are read in sequential order of knitting and are translated into pattern data for needle selection in each knitting course and/or control data for controlling knitting, transfer, rocking and like operations in each knitting course.

The following definitions are supplied in order to more clearly point out the present invention and to avoid ambiguity.

The term "fiber" is meant any thread, filament or the like, alone or in groups of multifilaments, continuous running lengths or short lengths such as staple. Fiber is defined as an elongated body, the length dimensions of which is much greater than the dimensions of width and thickness. Accordingly, the term fiber, as used herein includes a monofilament elongated body, a multifilamented elongated body, and the like having regular or irregular cross sections. The term fibers includes a plurality of any one or a combination of the above.

The cross section of fibers for use in this invention may vary widely. Useful fibers may have a circular cross section oblong cross section or irregular or regular multi-lobal cross section having one or more regular or irregular lobes projecting from the linear or longitudinal axis of the fibers. In the particularly preferred embodiments of the invention, the fibers are of substantially circular or oblong cross section and in the most preferred embodiment are of circular or substantially circular cross section.

In this disclosure the terms "fiber" and "filament" are used interchangeably. The term "yarn" is meant any continuous running length of fibers, which may be wrapped with similar or dissimilar fibers, suitable for further processing into fabric by braiding, weaving, fusion bonding, tufting, knitting or the like, having a denier less than 10,000.

The term "strand" is meant either a running length of multifilament end or a monofilament end of continuous fiber or spun staple fibers, preferably untwisted having a denier of less than 2000.

The term "performance fiber" is meant any fiber or filament having a high tensile modular of elasticity of about 5,000 kg/mm$^2$ or more that provides an enhanced performance function, such as in cut resistance, abrasion resistance, heat resistance or the like.

In general the specific filament or fiber combination is employed in any particular situation will depend to a large intent to the functional use of the apparel or outside. In the present invention along with enhancing the performance characteristics of the garment or article, the single layer construction reduces the weight and increases the flexibility and comfort factor. Furthermore, since the performance fiber can be specifically located anywhere on the fabric the amount of high performance fiber along with the expense can be reduced.

The type of fibers used in the fabrication of the present unilayer flexible performance textile fabric include organic polymer and inorganic fibers.

Preferably, filaments having a high tensile modulus of elasticity of 5,000 kg/mm$^2$ or more are usable for the performance fibers which are knitted into the base fabric. Illustrative of useful organic fibers having a high tensile modulus are those selected from the group consisting of aramid fibers, liquid crystal, copolyester fibers, nylon fibers, polyacrylonitrile fibers, polyester fibers, high modular weight polyvinylalcohol fibers and ultra high modular weight polyolefin fibers and mixtures thereof.

High modular weight polyethylene and polypropylene fibers are polyolefin fibers which may be used as performance fibers in preferred embodiments. In the use of polyethylene, suitable fibers are those which have a molecular weight of at least 150,000, preferably at least one million, and more preferably between two and five million. Such extended-chain polyethylene (EC PE) fibers are a high tensile material which are inherently resistant, as well as, being abrasion resistant and flexible providing a superior cut resistant yarn especially for protective gloves. SPECTRA® is a tradename of an ultra high molecular weight extended-chain polyethylene that is marketed.

Similarly, high oriented polypropylene fibers of molecular weight at least of 20,000 preferably at least one million, and more preferably at least two million may be used. Such high molecular weight polypropylene may be formed into reasonably well oriented fibers by techniques prescribed in U.S. Pat. No. 4,551,293 which is herein incorporated by reference. The particularly preferred ranges for the above-described parameters can advantageously provide improved performance in the final article and employed as a performance fiber.

High molecular weight polyvinyl alcohol fibers having a high tensile are described in U.S. Pat. No. 4,440,711 which is herein incorporated by reference. In the case of polyvinyl alcohol (PV—OH), PV—OH fibers having a weight average molecular weight of at least 200,000 may be used. Particularly useful PV—OH fibers should have a tensile modulus of at least 5,000 kg/mm$^2$ or more. Most preferred fibers are poly-p-phenylene terephthalate KEVLAR® filaments marketed under the tradename KEVLAR® and poly-m-phenylene terphthalate marketed under the tradename NOMEX® each by E. I. DuPont de Nemours &Co., Inc., Wilmington, Del. Each such aramid fiber has strong, high temperature resistant, cut resistant, puncture, and abrasion resistant properties. Most preferred are para-aramide fibers having a tensile modulus of elasticity of about 7,100 kg/mm$^2$.

Another high tensile fiber useful in certain applications of this invention is formed from polybenzimidazole polymers available from Celanese Corporation, Chatham N.J., under the tradename P.B.I.® fibers.

Polyacrylonitrite (PAN) fibers of a molecular weight of at least 400,000 are suitable. Since fibers are disclosed in U.S. Pat. No. 4,535,027 which is incorporated herein by reference.

Liquid crystal copolyester suitable in this invention are disclosed in U.S. Pat. Nos. 3,975,487 4,118,372 and 4,161,470 all hereby incorporated by reference.

In the case of nylon fibers, suitable fibers include those formed from nylon 6, nylon 10 and the like.

Suitable polyester fibers include polyethylene terephthalate.

Illustrative of useful inorganic fibers having a high tensile modulus are those selected from the group consisting of S-glass fibers, E-glass fibers, steel filaments, carbon fibers, boron fibers, aluminum fibers, zirconic-silica fibers, aluminum-silica fibers and mixtures thereof. Preferred are glass fibers having a tensile modulus of elasticity of about 7,000 kg/mm$^2$. Preferred steel filaments have a tensile modulus of elasticity of about 20,000 kg/mm$^2$.

Low tensile modulus fibers having a tensile modulus of 3,000 kg/mm$^2$ or less are effective for importing the high degree of flexibility to the unilayer base fabric and the susequent garment manufactured therefrom.

The synthetic fibers are preferably selected from the group consisting of viscose rayon fibers, aliphatic polyamide fibers, polyacrylic fibers, polyester fibers, water insoluble modified polyvinyl alcohol fibers and mixtures thereof. Most preferred fibers for the base fabric are natural fibers such as cotton and wool. Both fibers have the flexibility characteristics desired and provide a proper comfort level to wearer. For these reasons they can be positions proximate to wearers skin.

Fibers having a relatively low tensile modulus can be used independently or together with ordinary relatively low tensile modulus fibers, without difficulty, in the method of this invention.

The performance fiber can also be a blend of mixed fibers, i.e. a lower strength fiber with the high strength fiber. Likewise, the performance fiber could be a composite fiber wherein the matrix is a softer material impregnated with a hard material such as carbon or glass fibers.

In addition, the fibers can be composed of fibers with anti-microbial additives or otherwise impregnated with an anti-microbial agent.

Even one skilled in the art might assume that the hard fibrous materials used as part of this invention would be very brittle and therefore of limited use in protective garments where flexibility and comfort are of major concern. The glass or steel filaments which would normally be used in this invention are extremely small in diameter. If a larger diameter is required, an impregnated fiber, described above, can be used. As a result, these hard materials are still very flexible and can be bent around a very small radius without breaking. In this embodiment it is preferred that the hard fibrous material is located within the matrix of the yarn. By placing the hard material in the matrix of the yarn, the hard material is exposed to the least stress during bending of the yarn. Furthermore, by placing the hard material within the matrix, the outer portion of flexible material helps to protect the more brittle, harder component.

In many cases, it will be preferred that the hard fibrous material be coated with a continuous layer of elastic material. This coating has several functions. For example, if the hard material is a multifilament fiber, the coating holds the fiber bundle together and helps protect it from stresses that develop during the manufacturing process. Furthermore, the coating may provide a physical or chemical barrier for the hard material. Finally, if the hard material is broken during use, the coating will trap the material so that it will not leave the fibrous structure.

It is to be understood that the present invention provides for a multiplicity of embodiments by using any of a large number of protective materials in combination to form a composite in a single layered fabric. Consequently, the invented fabric can be made into a large variety of articles and protective apparel used for protection against numerous potential hazards.

EXAMPLE 1

A cut-resistant glove having isolated patterns of high tensile modulus fibers in critical locations is prepared.

The method of manufacture involves first chain-stitching a 100 percent cotton fiber on a programmed flat knitting machine, such as describer in U.S. Pat. No. 4,479,368, to form a base fabric in a mesh and web construction having a weight of about 4 to 7 oz/sq yd. After the base fabric is formed it is downloaded into a knitting machine into which the design of the isolated patterns have been programmed. KEVLAR® having a denier of the individual filament of 1.5 and a tensile modulus of 5900 kg/mm$^2$ is knitted into the same layer as the mesh and web of the base fabric. The movement of the knitting needle with respect to the palm portion and the finger and thumb stalls is controlled by a computer.

To complete the assembly of the glove, the edges of the back and palm portions, along with the finger and thumb stalls are secured by sewing aromatic polyamide fibers on a conventional industrial machine.

The glove has the desired qualities of high gripability, cut-resistance, puncture resistance, abrasion resistance, flexibility and softness.

It should be apparent to those skilled in the art, that other embodiments, improvements, details and uses can be made consistent with the letter and spirit of the foregoing disclosure and within the scope of this patent, which is limited only by the following claims construed in accordance with the patent statutes, including the doctrine of equivalents.

What is claimed is:

1. A unilayer flexible textile performance fabric comprising a base fabric having a predetermined design of a pattern continuously formed therein by a step of selectively manipulating and chain-stitching on a programmed knitting machine into said base fabric at least one dissimilar high performance fiber into said base fabric in the same layer with a preselected single needle wherein said step of manipulating is computer controlled and a unilayer fabric is formed.

2. The textile fabric of claim 1 wherein said base fabric is formed of fibers having a tensile modulus of elasticity of 3,000 kg/mm$^2$ or more.

3. The textile fabric of claim 1 wherein said high performance fiber has a tensile modulus of elasticity of 5,000 kg/mm$^2$ or more.

4. The textile fabric of claim 1 wherein said base fabric comprises fibers selected from natural and synthetic fiber.

5. The textile fabric of claim 4 wherein said natural fibers are selected from cotton or wool.

6. The textile fabric of claim 2 wherein said synthetic fibers are selected from the group consisting of rayon fibers, aliphatic polyamide fibers, polyacrylic fibers, polyester fibers, water-insoluble modified polyvinyl alcohol fibers, and mixtures thereof.

7. The textile fabric of claim 3 wherein said high performance fiber is selected from organic polymer and inorganic fibers.

8. The textile fabric of claim 7 wherein said high performance inorganic fiber is selected from the group consisting of S-glass fibers, E-glass fibers, steel filaments, carbon fibers, boron fibers, aluminum fibers, zirconin-silica fibers, aluminum-silica fibers and mixtures thereof.

9. The textile fabric of claim 7 wherein said organic polymer fiber is selected from the group consisting of aramid fiber, liquid crystal copolyester fiber, nylon fiber, polyacrylonitrate fiber, polyester fibers, polybenzimidazole fibers, high molecular weight polyvinylalcohol fiber, ultra high molecular weight polyolefin fibers and mixtures thereof.

10. The textile fabric of claim 1 comprising a cotton glove having at least one island of a unilayer synthetic or organic fibers.

11. A single layer protective fabric prepared on a programmed knitting machine comprising a base fabric formed by chain-stitching a first fiber, said base fabric having a design of a pattern formed continuously therein by the step of manipulating into said base fabric at the same layer at least one dissimilar high performance fiber with a preselected single needle, wherein said step of manipulating is controlled by an output signal from a programmed microprocessor so as to form at least one island of a high performance fiber as a unilayer.

12. A method of continuously manufacturing a unilayer flexible performance fabric on a programmed knitting machine comprising the steps of:

(a) manipulating a first fiber to chain-stitch and form a base textile fabric in a single unilayer; and (b) manipulating at least one dissimilar performance fibers with a preselected single needle into said base fabric to chain-stitch and form a single unilayer wherein the step of manipulating is computer controlled to produce a predetermined design for a pattern and to form a performance fabric having enhanced performance functions.

13. The method according to claim 12 further fabricating the performance fabric into a garment.

14. The method according to claim 13 wherein said garment is a glove.

* * * * *